US006568154B1

(12) United States Patent
Lundblad et al.

(10) Patent No.: US 6,568,154 B1
(45) Date of Patent: May 27, 2003

(54) METHOD AND APPARATUS FOR ENCLOSING BANKNOTES WHERE INFORMATION IS PRINTED ON THE INSIDE OF A TRANSPARENT FILM

(75) Inventors: Leif Lundblad, Stockholm (SE); Claes Björkman, Stockholm (SE); Gösta Edin, Rönninge (SE)

(73) Assignee: Nybohov Development AB, Stockholm (SE)

( * ) Notice: Subject to any disclaimer, the term of this patent is extended or adjusted under 35 U.S.C. 154(b) by 0 days.

(21) Appl. No.: 09/806,507

(22) PCT Filed: Oct. 8, 1999

(86) PCT No.: PCT/SE99/01812

§ 371 (c)(1),
(2), (4) Date: Apr. 16, 2001

(87) PCT Pub. No.: WO00/26863

PCT Pub. Date: May 11, 2000

(30) Foreign Application Priority Data

Oct. 22, 1998 (SE) ..... 9803617

(51) Int. Cl.[7] ..... B65B 61/26
(52) U.S. Cl. ..... 53/411; 53/500; 53/131.5
(58) Field of Search ..... 53/411, 131.2, 53/131.4, 131.5, 74, 500, 498, 501

(56) References Cited

U.S. PATENT DOCUMENTS 5,031,379 A 7/1991 Lundblad et al.
5,103,617 A * 4/1992 Sjogren et al. ..... 53/131.5
5,468,941 A 11/1995 Sasaki

FOREIGN PATENT DOCUMENTS

| | | |
|---|---|---|
| EP | 0 871 149 | 10/1998 |
| JP | 09169323 | 6/1997 |
| SE | 9501403 | 10/1996 |

* cited by examiner

*Primary Examiner*—Stephen F. Gerrity
(74) *Attorney, Agent, or Firm*—Jacobson Holman PLLC

(57) ABSTRACT

A banknote handling apparatus including a first unit for receiving banknotes deposited from outside the machine, a second unit for checking validity, quality and denomination of the deposited banknotes, and a third unit for bundling and packaging checked banknotes using a packaging device that has a roll carrying transparent packaging material for encasing banknotes in a closed package so that unnoticeable resealing of a banknote package that has been sealed in the apparatus and then broken open is difficult to achieve. A printing device is located above and close to the roll for printing information relating to the content of the banknote package with each bundling/encasing function in mirror image on an inner side of the transparent packaging material taken from the roll so that the content information is durably printed thereon and readable right-way-up from outside the closed package.

8 Claims, 2 Drawing Sheets

METHOD AND APPARATUS FOR ENCLOSING BANKNOTES WHERE INFORMATION IS PRINTED ON THE INSIDE OF A TRANSPARENT FILM

CROSS REFERENCE TO APPLICATION WITH EARLIER FILING DATE

This application is a National Stage filing under 35 U.S.C. §371 of International Application No. PCT/SE99/01812, which has an international filing date of Oct. 8, 1999 and which designated the United States of America.

FIELD OF INVENTION

The present invention relates to banknote handling equipment of the kind comprising a machine which is closed when in operation and which includes a unit for receiving banknotes fed externally into the machine, a unit for checking the validity, quality and denomination of deposited banknotes, and a unit for bundling and encasing or packaging checked banknotes. The banknote encasing means is adapted to encase banknotes to provide a closed package in a manner which effectively makes it difficult to unnoticeably re-close a banknote package which has been sealed in the equipment and then broken open. The equipment also includes means for printing information that discloses the contents of the package with respect to each bundling/encasing function.

BACKGROUND OF THE INVENTION

Equipment of the aforedescribed kind is known to the art. See for instance U.S. Pat. Nos. 5,031,379 and 5,468,941 in this respect. The ever increasing risk of robbery and burglary in conjunction with money handling procedures in general and handling of banknotes in particular makes it necessary to improve earlier known methods, apparatus and equipment with the intention of reducing the incitement to criminal activities in this respect. The present invention endeavours to provide an improvement in earlier known banknote handling equipment of a given kind.

SUMMARY OF THE INVENTION

In the case of banknote handling equipment of the aforedescribed kind, the printing device is adapted to print information disclosing the contents of a closed and sealed banknote package in mirror image on the inside of transparent encasement material intended for encasing banknotes to form a closed package so that information relating to the closed package will be the right side up, durable and visible from outside said package. This is believed to considerably reduce the possibility of resealing a package of banknotes in a manner that cannot be noticed, or of manipulating the information.

BRIEF DESCRIPTION OF THE DRAWINGS

The invention will now be described in more detail with reference to the accompanying schematic drawings, in which.

DESCRIPTION OF PREFERRED EMBODIMENTS

Figure 1:
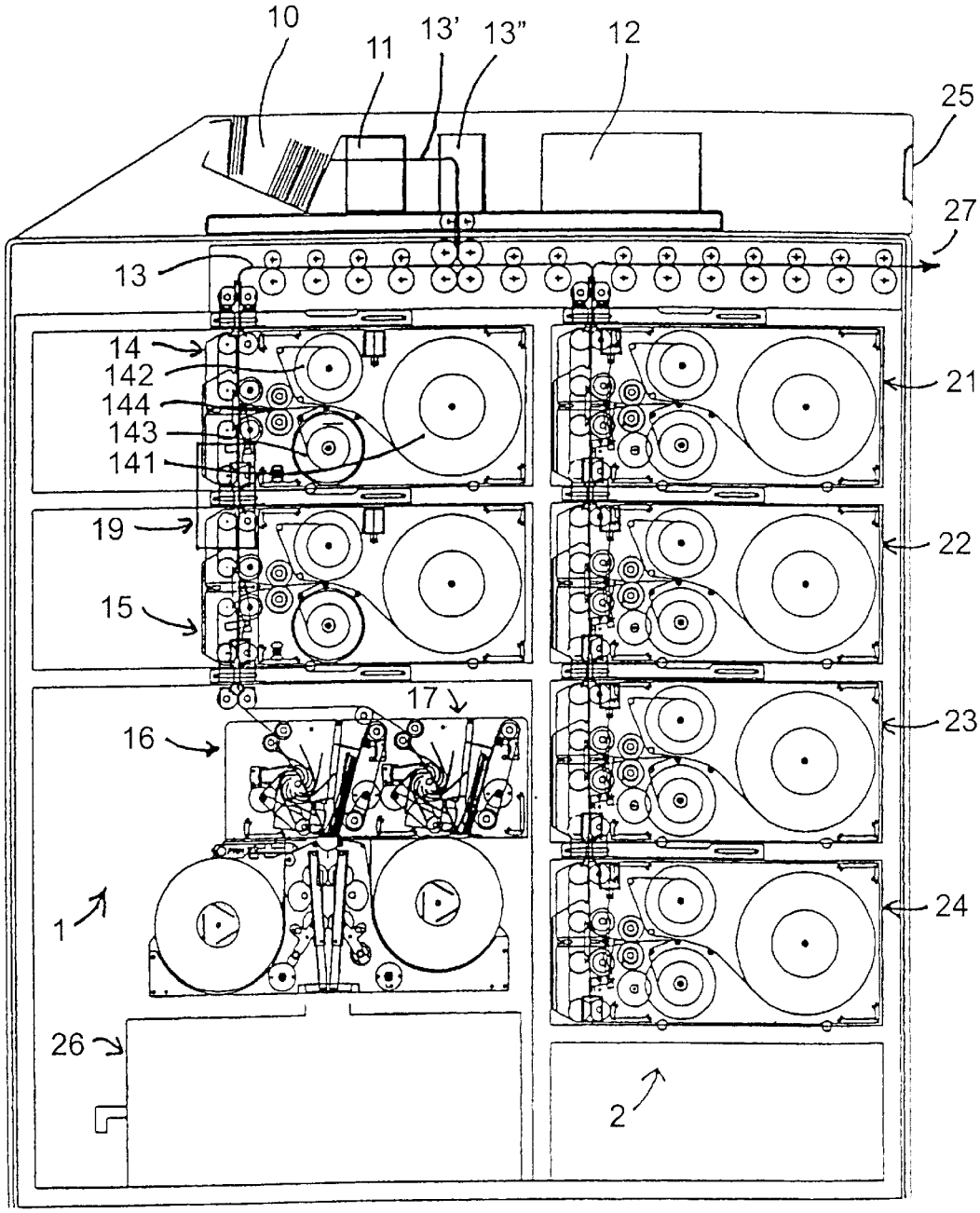
FIG. 1 illustrates a banknote handling machine according to the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within Lathe spirit and scope of the invention will become apparent to those skilled in the,art from this detailed description.

The inventive banknote handling machine has an infeed part 1 and an outfeed part 2. The infeed part 1 includes a deposit compartment 10, a detector means 11, a process unit 12, a conveyor path 13', 13", 13, first storage means 14, second storage means 15, first stacker means 16, second stacker means 17 and an encasement or packaging unit 18.

When banknotes are deposited, a bundle of banknotes, optionally of different denominations, are placed in the deposit compartment 10, which can accommodate up to 500 banknotes. These banknotes are separated one after the other, and moved along an upper conveyor path 13', past the detector means 11 and up to a guide means (direction changing means) 13", which leads the banknotes down to lower conveyor path 13.

The detector means 11 is placed in the close proximity of the deposit compartment 10 and is adapted to sort out any non-genuine banknotes, banknotes of poor quality, and other banknotes. By sorting is meant here that passing banknotes are "marked" in some way so that they can be treated as "possibly non-genuine" banknotes, banknotes of "poor" quality, or as accepted banknotes during their subsequent transportation.

The storage device 14, and also a plurality of other similar storage devices in the machine, includes two belts between which banknotes are stored, a storage 141 and two unreeling drums 142 and 143. The leading edge of a banknote arriving at the device activates a sensor 144 which therewith starts three motors each of which drives a respective drum 141–143. The banknote is drawn about 120 mm in between the belts and the belts are wound up on the storage drum 141, which has room for about 500 banknotes. Information relating to the banknotes is sent to the process unit 12 as the belts are coiled onto the storage drum. This enables an account to be kept of the sequence between the banknotes. Banknotes are taken from the device 14, by sending pulses to the motors which cause the drums to rotate in opposite directions.

A manipulator 19 provided along the conveyor path close to the storage devices 14, 15 functions to correct the positions of any banknotes that may have been twisted or displaced laterally during their transportation.

The stacker devices 16, 17 each include a so-called stacker wheel which bundles together mutually sequential banknotes fed in to a storage compartment. When the bundle contains an intended number of banknotes, the bundle is clamped by a pair of arms and fed down to the encasing unit or packaging 18.

The encasing unit 18 includes two rollers that carry encasing material (plastic). A banknote bundle to be encased, or packaged, is pulled down into a pocket that includes plastic strips of mutually the same length and width, one from each roller. The plastic strips are pressed together around the bundle and welded together along their edges with the aid of a Teflon®-coated heating wire. The reader is referred to U.S. Pat. No. 5,031,379 for a more detailed explanation of this known technique.

The process unit 12 controls transportation of poor-quality banknotes along the conveyor path 13 to a unit 16-18 for storing and encasing these banknotes. This unit comprises the stacker device 16 and the encasing device 18.

The process unit 12 also controls the transportation of at least some of the remaining genuine and accepted banknotes to unit 14-17-18 for storing and encasing these banknotes in denominational order. This unit is comprised of the storage device 14, the stacker device 17 and the encasing unit 18.

The manner in which the process unit 12 controls the passage of banknotes along different parts of the conveyor path 13 to different destinations with the aid of path selectors, detectors, sensors, etc., is well known to the art and will not therefore be described in more detail here.

Any non-genuine (false) banknotes detected in the detector device 11 may be transported, for instance, to the stacker device 16 and then to the encasing unit 18 in which they are encased or packaged and in which there is dispensed automatically a receipt on which the number of banknotes, the date, etc., is written together with information showing who has deposited the banknotes, e.g. through an account number. This enables the source or false or suspect banknotes to be investigated.

Figure 2:
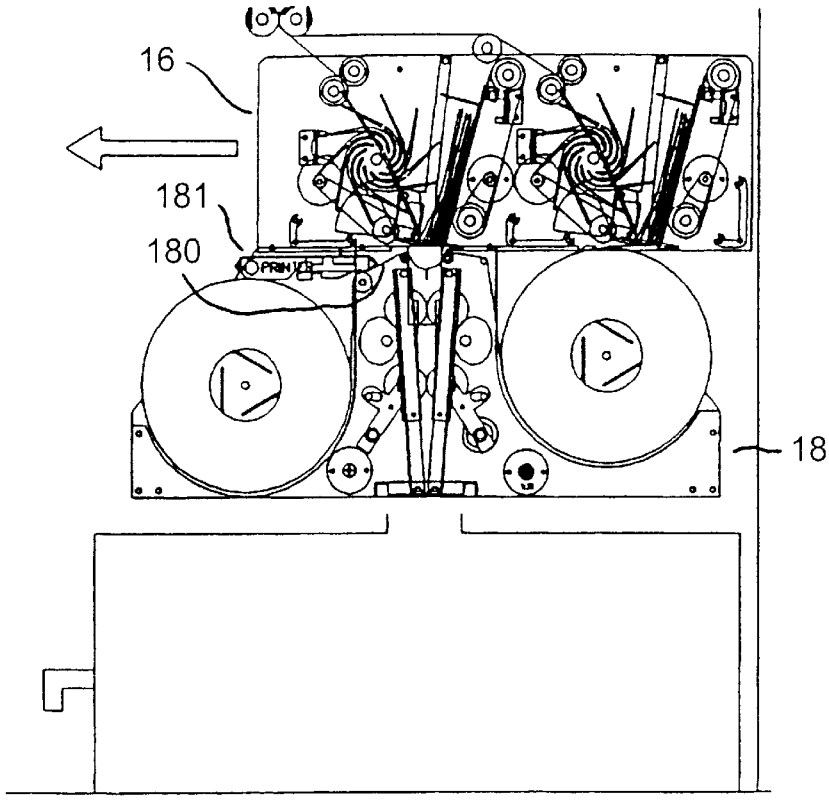
FIG. 2 illustrates in slightly larger scale a unit for storing and encasing banknotes and included in the machine shown in FIG. 1.

FIG. 2 shows the stacker device 16 and the encasing device 13 in modes in which a unit 16-18 stores and encases any false banknotes. A printing device 181 is provided for mirror-image printing of information relating to customers and any detected false banknotes (possibly several banknotes) directly onto the inner surface of the encasing material (the plastic strip) 180. The process unit 12 controls the transportation of the banknote (banknotes) and the printing of said information. Thus, if several suspect banknotes are detected on one and the same infeed occasion, these banknotes will be collected in one and the same package on which durable information relating to the contents of the package is printed.

Naturally, the printing procedure will be the same for genuine and accepted banknotes, these banknotes being transported to unit 14-17-18 for storage and encasement as earlier mentioned.

Figure 3:
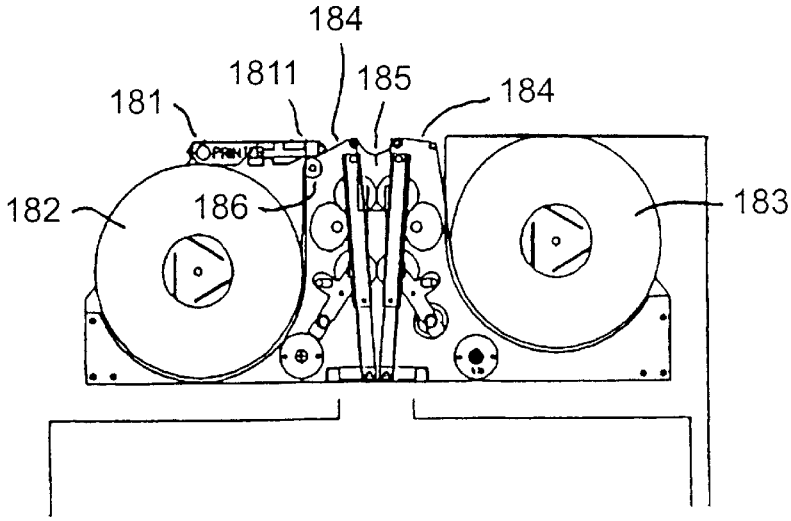
FIG. 3 illustrates an encasement mechanism included in the machine shown in FIG. 1.

FIG. 3 shows the actual packaging mechanism, which includes the rolls 182, 183 carrying said plastic or packaging material 184. The-ends of the packaging material taken from the two rolls are welded together at 185 (after a preceding packaging operation). and form the bottom of a disposable cassette or encasement for receiving a banknote (banknotes) fed down from above. The printing device 181 is mounted above and close to the roll 182, with the printing head 1811 of said device close to a guide roller 186 and at the upper side of the plastic material 184, this side thus being the inside of the cassette or encasement when a banknote (banknotes) is fed down from above between two lengths of plastic, one from each roll, whereafter these lengths are then welded together to form a closed cassette or encasement. It is thus important that the print is applied close to the weld joint 185.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A banknote handling machine comprising:

a first unit for receiving banknotes deposited from outside the machine;

a second unit for checking validity, quality and denomination of banknotes deposited through said first unit;

a third unit for bundling a varying number of one or more checked banknotes received from said second unit into a bundle and including a packaging device having a roll carrying transparent packaging material for encasing said bundle into a closed package that is difficult to unnoticeably open and reseal; and a printing device located above and close to said roll for durably printing information relating to said bundle and specific to said number of banknotes in said bundle, in mirror image on an inner side of said transparent packaging material taken from said roll, so that said information relating to said bundle is readable right-way-up from outside said closed package.

2. The banknote handling machine as set forth in claim 1, wherein said packaging device includes a second roll carrying transparent packaging material, a sheet of material from each of said rolls being welded together at a joint to form said package encasing one or more banknotes, said printing device located so as to apply said printed information adjacent said welded joint.

3. The banknote handling machine as set forth in claim 2, further comprising a process unit for controlling transportation of banknotes through said machine and for controlling the printing of information on banknote bundles in response to banknotes detected.

4. The banknote handling machine as set forth in claim 1, wherein said machine is closed during operation thereof.

5. The banknote handling machine as set forth in claim 1, further comprising a process unit for controlling transportation of banknotes through said machine and for controlling the printing of information on banknote bundles in response to banknotes detected.

6. The banknote handling machine as set forth in claim 1, wherein said varied number of one or more checked banknotes is determined by a number of banknotes suspected of being false banknotes.

7. A method of handling banknotes in a banknote handling machine comprising the steps of:

receiving banknotes deposited from outside the machine in a first unit;

checking validity, quality and denomination of the banknotes from said first unit in a second unit;

conveying a varied number of checked banknotes suspected of being false banknotes to a third unit;

bundling said varied number of suspected banknotes into a bundle and encasing said bundle in a transparent packaging material to form a closed package that is difficult to unnoticeably open and reseal; and durably printing information relating to said bundle and specific to said number of suspected banknotes in said bundle in mirror image on an inner side of said transparent packaging material so that said information relating to said bundle and specific to said number of suspected banknotes in said bundle is readable right-way-up from outside said closed package.

8. The method as set forth in claim 7, further comprising the step of forming said closed package by welding two sheets of material at a joint, said printed information being applied adjacent said welded joint.

* * * * *